US008763830B2

(12) United States Patent
Sadiq et al.

(10) Patent No.: US 8,763,830 B2
(45) Date of Patent: Jul. 1, 2014

(54) TAMPER-EVIDENT CLOSURE HAVING TAMPER-INDICATING PILFER BAND WITH PROJECTIONS AND PACKAGE INCLUDING THE TAMPER-EVIDENT CLOSURE

(75) Inventors: Sohail Sadiq, Crawfordsville, IN (US); John Edie, Linden, IN (US); David E. Gevers, Lafayette, IN (US); William Moll, Bloomingdale, IN (US)

(73) Assignee: Closure Systems International Inc., Indianapolis, IN (US)

( * ) Notice: Subject to any disclaimer, the term of this patent is extended or adjusted under 35 U.S.C. 154(b) by 383 days.

(21) Appl. No.: 13/037,061

(22) Filed: Feb. 28, 2011

(65) Prior Publication Data

US 2012/0091134 A1 Apr. 19, 2012

Related U.S. Application Data

(60) Provisional application No. 61/393,438, filed on Oct. 15, 2010.

(51) Int. Cl.
*B65D 41/34* (2006.01)

(52) U.S. Cl.
USPC ..... 215/252; 215/253; 215/256; 215/901; 220/268; 220/276

(58) Field of Classification Search
USPC ..... 215/252, 256, 344, 250, 901; D9/449, D9/450, 453; 220/265, 266, 268–270, 276, 220/279, 280
See application file for complete search history.

(56) References Cited

U.S. PATENT DOCUMENTS

| | | | | | |
|---|---|---|---|---|---|
| 3,901,403 | A | * | 8/1975 | Menke | 215/251 |
| 4,166,552 | A | * | 9/1979 | Faulstich | 215/256 |
| 4,305,516 | A | * | 12/1981 | Perne et al. | 215/252 |
| 4,326,639 | A | * | 4/1982 | Stahl et al. | 215/252 |
| 4,346,811 | A | * | 8/1982 | Hilaire | 215/252 |
| 4,394,918 | A | * | 7/1983 | Grussen | 215/243 |
| 4,402,418 | A | * | 9/1983 | Ostrowsky | 215/252 |
| 4,458,821 | A | * | 7/1984 | Ostrowsky | 215/252 |
| 4,470,513 | A | * | 9/1984 | Ostrowsky | 215/252 |
| 4,478,343 | A | * | 10/1984 | Ostrowsky | 215/252 |
| 4,485,934 | A | * | 12/1984 | Maguire | 215/252 |
| 4,534,479 | A | * | 8/1985 | Conti | 215/252 |
| 4,540,100 | A | * | 9/1985 | Willis | 215/252 |
| 4,550,844 | A | * | 11/1985 | Lininger | 215/252 |
| 4,562,931 | A | * | 1/1986 | Brach et al. | 215/220 |
| 4,593,830 | A | * | 6/1986 | Bullock | 215/256 |
| 4,595,110 | A | * | 6/1986 | Herr | 215/252 |
| 4,613,052 | A | * | 9/1986 | Gregory et al. | 215/252 |
| 4,643,321 | A | * | 2/1987 | Gach | 215/252 |
| 4,657,153 | A | * | 4/1987 | Hayes | 215/252 |
| 4,664,278 | A | * | 5/1987 | Barriac | 215/252 |

(Continued)

*Primary Examiner* — Anthony Stashick
*Assistant Examiner* — Ned A Walker
(74) *Attorney, Agent, or Firm* — Wood, Phillips, Katz, Clark & Mortimer

(57) ABSTRACT

A tamper-indicating plastic closure, and tamper-evident package includes a closure wherein the closure includes a pilfer band having a substantially continuous tamper-ring. The tamper-ring extends generally angularly upwardly and inwardly of the closure in a tamper-indicating orientation of the tamper-ring for engagement with a relatively enlarged annular locking ring of the associated container. The tamper-ring includes a plurality of circumferentially spaced projections, which comprise relatively thick regions or shoulders, which act to limit lateral movement of the pilfer band with respect to the container by engagement of at least one shoulder with the associated container generally beneath the container locking ring.

10 Claims, 2 Drawing Sheets

(56) References Cited

U.S. PATENT DOCUMENTS

| | | | | | |
|---|---|---|---|---|---|
| 4,667,838 | A * | 5/1987 | Yeager | 215/252 |
| 4,667,839 | A * | 5/1987 | Crisci | 215/256 |
| 4,801,030 | A * | 1/1989 | Barriac | 215/252 |
| 4,856,665 | A * | 8/1989 | Dutt et al. | 215/252 |
| 4,938,370 | A * | 7/1990 | McBride | 215/252 |
| 4,981,230 | A * | 1/1991 | Marshall et al. | 215/252 |
| 5,076,453 | A * | 12/1991 | Odet | 215/252 |
| 5,207,783 | A * | 5/1993 | Burton | 215/256 |
| 5,456,375 | A * | 10/1995 | May | 215/252 |
| 5,465,876 | A * | 11/1995 | Crisci | 222/153.1 |
| 5,547,092 | A * | 8/1996 | Thompson | 215/252 |
| 5,564,582 | A * | 10/1996 | Kamath | 215/252 |
| 5,573,128 | A * | 11/1996 | Tsujiguchi et al. | 215/252 |
| 5,678,714 | A * | 10/1997 | Guglielmini | 215/252 |
| 5,711,443 | A * | 1/1998 | Bennett | 215/256 |
| 5,715,959 | A * | 2/1998 | Pfefferkorn et al. | 215/252 |
| 5,720,402 | A * | 2/1998 | May | 215/252 |
| 5,725,115 | A * | 3/1998 | Bosl et al. | 215/252 |
| 5,749,484 | A * | 5/1998 | Trout | 215/219 |
| 5,769,263 | A * | 6/1998 | Willingham et al. | 220/522 |
| 5,806,707 | A * | 9/1998 | Boehm et al. | 220/522 |
| 5,813,563 | A * | 9/1998 | Boehm et al. | 220/522 |
| 5,862,953 | A * | 1/1999 | Long, Jr. | 222/153.06 |
| 5,891,380 | A * | 4/1999 | Larue et al. | 264/296 |
| 5,913,436 | A * | 6/1999 | Breuer | 215/252 |
| 6,029,834 | A * | 2/2000 | Sanner | 215/215 |
| 6,039,196 | A * | 3/2000 | Ekkert et al. | 215/216 |
| 6,050,436 | A * | 4/2000 | Bennett et al. | 215/256 |
| 6,213,321 | B1 * | 4/2001 | Zumbuhl | 215/252 |
| 6,253,939 | B1 * | 7/2001 | Wan et al. | 215/252 |
| 6,325,226 | B1 * | 12/2001 | Krautkramer | 215/252 |
| 6,332,550 | B1 * | 12/2001 | Bennett et al. | 215/256 |
| 6,557,714 | B2 * | 5/2003 | Babcock et al. | 215/252 |
| 6,769,575 | B1 * | 8/2004 | Long, Jr. | 222/153.06 |
| 6,779,672 | B2 * | 8/2004 | Kano et al. | 215/344 |
| 7,014,055 | B2 * | 3/2006 | Kano et al. | 215/344 |
| 7,243,807 | B2 * | 7/2007 | Lin | 215/235 |
| 7,264,131 | B2 * | 9/2007 | Tsutsumi et al. | 215/344 |
| D578,889 | S * | 10/2008 | Sadiq | D9/453 |
| 7,451,898 | B2 * | 11/2008 | Seidita | 222/253 |
| 7,503,468 | B2 * | 3/2009 | Druitt et al. | 222/344 |
| 7,527,159 | B2 * | 5/2009 | Brozell | 215/222 |
| 7,575,121 | B2 * | 8/2009 | Ooka et al. | 215/344 |
| 7,581,652 | B2 * | 9/2009 | Flak et al. | 215/252 |
| 7,607,547 | B2 * | 10/2009 | Kumata et al. | 215/252 |
| 7,645,414 | B2 * | 1/2010 | Gregory et al. | 264/320 |
| 7,651,004 | B2 * | 1/2010 | Fuchs | 215/344 |
| 7,703,642 | B2 * | 4/2010 | Scott | 222/522 |
| 7,802,690 | B2 * | 9/2010 | Lohrman et al. | 215/305 |
| 7,857,154 | B2 * | 12/2010 | Pedlar | 215/256 |
| 7,867,425 | B2 * | 1/2011 | Major | 264/268 |
| 7,905,820 | B2 * | 3/2011 | Druitt | 493/114 |
| 8,066,133 | B2 * | 11/2011 | Takamatsu et al. | 215/344 |
| 8,365,934 | B2 * | 2/2013 | Hamana et al. | 215/330 |
| 8,393,483 | B2 * | 3/2013 | Druitt | 215/344 |
| 2001/0027957 | A1 * | 10/2001 | Kano | 215/341 |
| 2004/0060893 | A1 * | 4/2004 | Kano et al. | 215/344 |
| 2004/0155006 | A1 * | 8/2004 | Seidita | 215/252 |
| 2004/0238478 | A1 * | 12/2004 | Druitt et al. | 215/344 |
| 2005/0077264 | A1 * | 4/2005 | Fuchs | 215/252 |
| 2005/0173367 | A1 * | 8/2005 | Nusbaum et al. | 215/237 |
| 2005/0211659 | A1 * | 9/2005 | Tsutsumi et al. | 215/344 |
| 2005/0252878 | A1 * | 11/2005 | Babcock | 215/252 |
| 2006/0032831 | A1 * | 2/2006 | Major | 215/350 |
| 2006/0138071 | A1 * | 6/2006 | Tsutsumi et al. | 215/252 |
| 2006/0138073 | A1 * | 6/2006 | Ooka et al. | 215/344 |
| 2006/0151418 | A1 * | 7/2006 | Scott | 215/257 |
| 2006/0255002 | A1 * | 11/2006 | Takamatsu et al. | 215/252 |
| 2006/0255003 | A1 * | 11/2006 | Fuchs | 215/252 |
| 2007/0023380 | A1 * | 2/2007 | Shingle et al. | 215/217 |
| 2007/0034590 | A1 * | 2/2007 | Hidding | 215/252 |
| 2007/0090080 | A1 * | 4/2007 | Lohrman et al. | 215/305 |
| 2007/0181525 | A1 * | 8/2007 | Gregory et al. | 215/252 |
| 2008/0067142 | A1 * | 3/2008 | Druitt | 215/324 |
| 2008/0087625 | A1 * | 4/2008 | Kumata et al. | 215/252 |
| 2008/0093363 | A1 * | 4/2008 | Pedlar | 220/276 |
| 2008/0314000 | A1 * | 12/2008 | Druitt | 53/490 |
| 2009/0045158 | A1 * | 2/2009 | Suriol | 215/256 |
| 2009/0159555 | A1 * | 6/2009 | Druitt et al. | 215/344 |
| 2009/0261057 | A1 * | 10/2009 | Druitt et al. | 215/341 |
| 2010/0276387 | A1 * | 11/2010 | Hamana et al. | 215/330 |

* cited by examiner

TAMPER-EVIDENT CLOSURE HAVING TAMPER-INDICATING PILFER BAND WITH PROJECTIONS AND PACKAGE INCLUDING THE TAMPER-EVIDENT CLOSURE

CROSS-REFERENCE TO RELATED APPLICATION

This application claims priority of U.S. Provisional Application Ser. No. 61/393,438, filed Oct. 15, 2010, the disclosure of which is incorporated herein by reference.

TECHNICAL FIELD

The present invention relates generally to plastic closures molded from polymeric materials, and more particularly to a tamper-evident plastic closure, wherein the closure is configured for enhanced cooperation with an associated container to provide a tamper-evident package having improved performance characteristics, while desirably achieving material weight savings.

BACKGROUND OF THE INVENTION

Plastic closures formed from polymeric materials have met with widespread acceptance in the marketplace. Closures of this type, which have found particular applicability for carbonated and non-carbonated beverages, as well as for other applications, can be configured to provide the desired sealing performance, as well as desired tamper-indicating properties. Closures of this nature can be efficiently formed by injection molding or compression molding formation techniques.

Economical use of these types of closures has been promoted by reducing the polymeric material required for forming each closure, that is, making each closure more lightweight. However, in this regard, certain dimensional and performance characteristics become important. In particular, closures of this nature are typically applied to associated containers by high-speed, automatic capping equipment, including capping heads or chucks which rotatably fit each internally threaded closure to an associated, externally threaded container. Closures configured for tamper-indication typically include a tamper-indicating pilfer band depending from a skirt portion of the closure, which pilfer band is configured for cooperative engagement with the associated container so that the pilfer band is either partially or completely separated from the remainder of the skirt portion during initial removal of the closure from the container.

As will be appreciated, it is important that closure pilfer band remain intact attendant to high-speed application to an associated container, notwithstanding the inevitable interfering engagement of the closure pilfer band with portions of the container, such as its external thread formation, attendant to initial closure application. During typical closure application, closures are applied to bottles or other containers by rotation, until the closure/container thread interactions draw the closure down against the closure sealing feature, which contacts the upper extreme rim of the container finish.

One type of closure tamper-indicating pilfer band includes a substantially continuous ring which extends generally upwardly and inwardly into the interior of the closure. Closures of this nature can exhibit some problems attendant to high-speed application. In particular, if there is too much interference around the entire ring with the so-called "A diameter" of the container, at the relatively enlarged annular container locking ring, the closure will be difficult to apply without folding the pilfer band ring up into the closure. On balance, if there is insufficient interference, there is a chance that the tamper-indicating function of the pilfer band can be impaired by the ring becoming wedged between the band portion of the pilfer band, and the A-diameter of the container during removal of the closure.

The present invention contemplates an improved configuration of a pilfer band for a tamper-indicating closure which enhances engagement with an associating container, but desirably avoids the addition of too much weight to the closure, and further desirably avoids creating too much resistance and hoop stress as the pilfer band moves over the container finish during closure or application.

SUMMARY OF THE INVENTION

A tamper-indicating plastic closure, and tamper-evident package, in accordance with the present invention includes a closure cap having a tamper-indicating pilfer band depending from a skirt portion of the closure cap. The pilfer band includes an annular band portion depending from, and at least partially detachably connected to, the skirt portion of the closure cap. A substantially continuous tamper-ring extends inwardly and upwardly from a lower edge of the annular band portion of the pilfer band, in a tamper-indicating orientation of the tamper-ring. In this orientation, the tamper-ring is configured for engagement with a generally downwardly facing surface of an annular locking ring of the associated container.

In accordance with the present invention, the tamper-ring includes a plurality of circumferentially spaced, radially extending, projections which project generally radially inwardly when the taper band is in its tamper-indicating orientation. Notably, the projections act to limit lateral movement of the pilfer band with respective container for desirably enhancing engagement of the pilfer band with the container by engagement of at least one of the projections with the container generally beneath the container locking ring.

In accordance with the illustrated embodiment, the present plastic closure includes a closure cap having a top wall portion, and an annular strip portion depending from the top wall portion. The skirt portion includes an internal thread formation configured for threaded engagement with an external thread formation on an associated container.

As noted, the closure cap includes a tamper-indicating pilfer band depending from the skirt portion of the closure cap. A frangible connection, such as in the form of a plurality of frangible ribs or bridges, at least partially detachably connects the pilfer band to the skirt portion of the closure cap. The closure pilfer band includes a substantially continuous tamper-ring, having a generally frusto-conical configuration, extending inwardly and upwardly from a lower edge of the annular band portion of the pilfer band. In this tamper-indicating orientation, the tamper-ring is positioned from engagement with a generally downwardly facing surface of a locking ring of the associated container.

As noted, tamper-evidence is enhanced by providing the tamper-ring with a plurality of circumferentially spaced, radially extending projections which project generally radially inwardly when the tamper-ring is in its tamper-indicating orientation. Notably, at least one of the projections of the tamper-ring is engageable with the container generally beneath the container locking ring in order to limit lateral movement of the pilfer band with respect to the container. By this cooperation of the projections with the container finish, and the attendant limiting of lateral movement of the pilfer band with respect to the container finish, the portion of the tamper-ring opposite the one or more projections engaging the container finish beneath the locking ring is maintained in the desired cooperative engagement with the generally downwardly facing surface of the locking ring, thus acting to ensure the desired tamper-indicating function.

In accordance with the illustrated embodiments, the tamper-ring of the pilfer band includes a plurality of circumferentially spaced apart tabs which extend from a free edge of the tamper-ring for enhancing engagement of the tamper-ring with the container during removal of the closure. In accordance with one illustrated embodiment, the projections on the tamper-ring are provided in the form of relative thick, ramp-like shoulders on the tamper-ring. In this illustrated embodiment, the plurality of spaced apart tabs are respectively aligned with the plurality of circumferentially spaced shoulders. The tabs are positionable generally between the container locking ring and the band portion of the closure pilfer band when the closure is fully applied to the container, thus further desirably enhancing the tamper-indicating cooperation between the closure pilfer band and the container during closure removal. In an alternate embodiment, the tamper-ring projections are provided in the form of radially-oriented, upstanding ribs. In this embodiment, the plurality of the spaced apart tabs of the tamper-ring are respectively positioned adjacent to the plurality of radially-oriented ribs.

In the preferred form of the invention, a plurality of spaced apart fragible bridges detachably connect the closure pilfer band to the skirt portion of the closure cap. Notably, it is preferred that the number of frangible bridges be different than, typically greater than, the number of tamper-ring projections, with each of the bridges being non-aligned and spaced from the projections. This desirably acts to avoid application of excessive stress to any of the frangible bridges during closure application, as the tamper-ring projections pass over the A-diameter of the container at the container locking ring.

Other features and advantages of the present invention will become readily apparent from the following detailed description, the accompanying drawings, and the appended claims.

DETAILED DESCRIPTION

Figure 1:
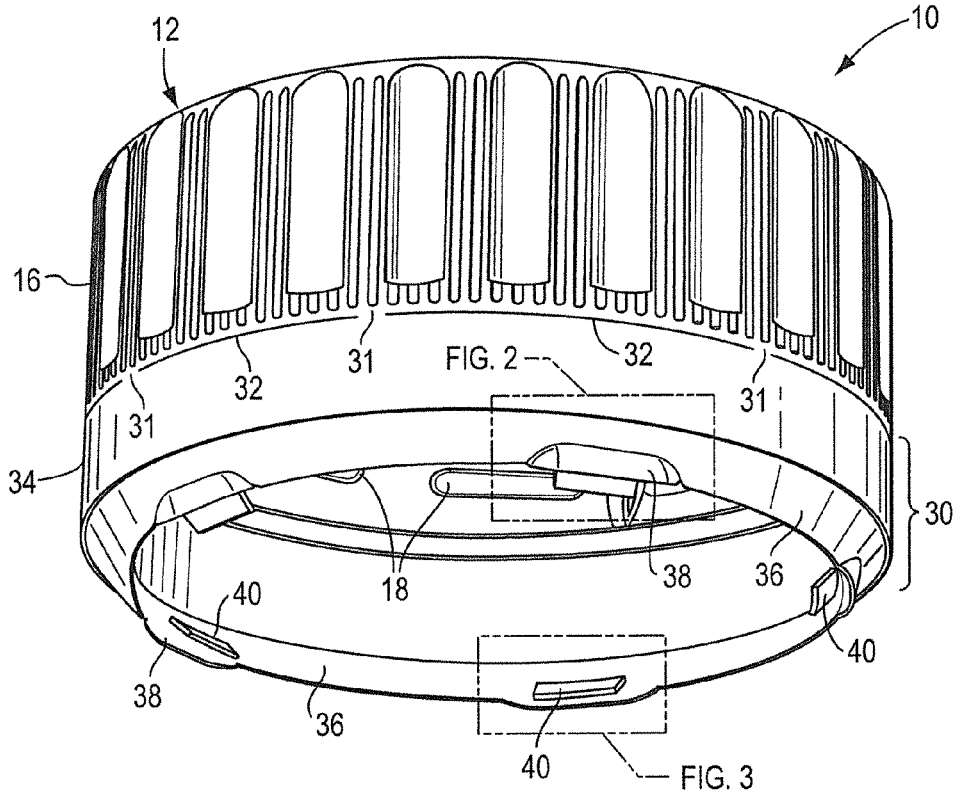
FIG. 1 is a perspective view of a tamper-evident closure embodying the principles of the present invention, illustrating a pilfer band of the closure generally in its "as molded" orientation, prior to inversion of a tamper-ring of the pilfer band to its tamper-indicating orientation.
Figure 2:
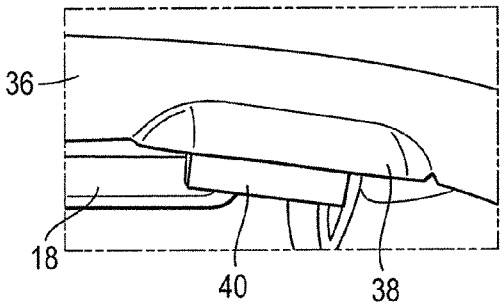
FIG. 2 is a relatively enlarged, fragmentary perspective view of the closure pilfer band shown in FIG. 1, showing the exterior surface of the pilfer band when the pilfer band is in its "as molded" orientation.
Figure 3:
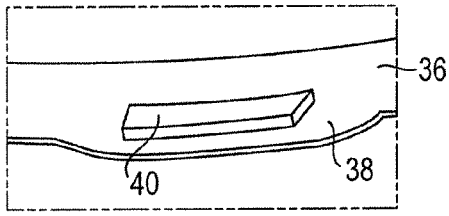
FIG. 3 is an enlarged, fragmentary perspective view of the pilfer band of FIG. 1, showing an interior surface of the pilfer band in its "as molded" orientation of FIG. 1.

While the present invention is susceptible of embodiment in various forms, there is shown in the drawings and will hereinafter be described presently preferred embodiments, with the understanding that the present disclosure is to be considered as an exemplification of the invention and is not intended to limit the invention to the specific embodiments disclosed herein.

With reference now to the drawings, therein is illustrated a tamper-indicating plastic closure 10 embodying the principles of the present invention. Closure 10 can be efficiently formed by injection or compression molding techniques, as are known in the art, from suitable polymeric materials, such as polyperperlene, polyethelene, and the like.

Closure 10 includes a unitary closure cap 12 having a top wall portion 14, and an annular depending skirt portion 16 having an internal thread formation 18. The thread formation 18 is configured for threaded engagement with an external thread formation 20 provided on the neck portion of an associated container C. The illustrated container C, shown diagrammatically in FIG. 4, includes a relatively enlarged annular locking ring 22 with which tamper-evident closure 10 cooperates to provide a tamper-evident package embodying the principles of the present invention.

In the illustrated embodiment, closure 10 is shown as a so-called linerless closure, in that the closure does not include a separate sealing linear positioned at the inside surface of the top wall portion 14 of the closure cap 12. Rather, in the illustrated embodiment, closure cap 12 includes an annular plug seal element 24, positionable generally within the mouth of the associated container C, and an annular external seal 26 engageable with a generally outwardly facing surface of the neck portion of the container. It will be understood that the specific configuration of the sealing features of the closure 10 can be varied while keeping with the principles disclosed herein relating to enhancing tamper-indicating performance of the closure and container package.

Tamper-indication for the closure/container package is provided by an annular pilfer band 30 which is at least partially detachably connected to the skirt portion 16 of closure cap 12. Detachable connection of the pilfer band 30 to the skirt portion 16 can be achieved by providing a plurality of circumferentially spaced frangible bridges or ribs 31 extending between the pilfer band and skirt portion. A frangible connection can be efficiently formed by molding the closure cap 12 integrally with the pilfer band 30, and thereafter cutting or scoring the closure so that the frangible bridges 31 remain to provide the desired frangible connection between the pilfer band and the skirt portion. The closure 10 has been circumferentially cut or scored, generally at 32, by which the pilfer band 30 is distinguished from the skirt portion 16, with the bridges 31 providing the desired frangible connection between the pilfer band and the skirt portion.

In accordance with the present invention, the pilfer band 30 of closure 10 includes an annular portion 34 generally aligned with skirt portion 16 of the closure cap. The pilfer band 30 further includes a substantially continuous, generally frustal-conical tamper-ring 36 extending from and formed integrally with the annular band portion 34 of the pilfer band 30. In FIG. 1, tamper-ring 36 is generally illustrated in its "as molded" orientation, wherein the tamper-ring 36 extends generally angularly downwardly from the annular band portion 34 of the pilfer band 30. Prior to application of closure 10 to the associated container C, suitable tooling is employed for inverting the tamper-ring 36 to a tamper-indication orientation, wherein the tamper-ring 36 extends generally inwardly upwardly of the lower edge of the annular band portion 34 for cooperative, tamper-indicating engagement with the locking ring 22 of the associated container C. Tamper-ring 36 is diagrammatically illustrated in this tamper-indicating orientation in FIG. 4.

As will be appreciated, tamper-indicating cooperation of the tamper-ring 36 with the container locking ring 22 provides the desired tamper-evident function by partially or completely separating the pilfer band 30 from the skirt portion 16 during initial removal of the closure 10 from the associated container C by breakage of one or more of the frangible bridges 31. In particular, the inner, free edge of the tamper-ring 36 is configured for cooperative engagement with a generally downwardly facing surface of the container locking ring 22 attendant to closure removal, whereby unthreading movement of the closure with respect to the container acts to at least partially detachably connect the pilfer band from the skirt portion by fracture and breakage of the frangible connection provided there between.

As will be appreciated by those skilled in the art, it is desirable to configure the tamper-ring 36 for predictable and reliable engagement with the generally downwardly facing surface of the container locking ring 22. On balance, it will be appreciated that the tamper-ring 36, positioned in its upwardly, inwardly extending tamper-indicating orientation, must pass over features of the container finish, including thread formation 20 and locking ring 22, during high-speed application of the closure to the container, without premature fracture or failure of the frangible connection between the pilfer band and the closure cap skirt portion 16. When these somewhat conflicting design criteria are considered, together with normal manufacturing tolerances for the closure and container, there can sometimes be sufficient clearance between the closure pilfer band 30 and the finish of the container neck such that the pilfer band 30 can be urged or forced to exhibit limited lateral movement with respect to the closure finish. Such lateral movement can undesirably result in a portion of the tamper-ring 36 being moved to a position generally away from the container so that the free edge of the tamper-ring does not properly engage the closure locking ring 22.

Figure 4:
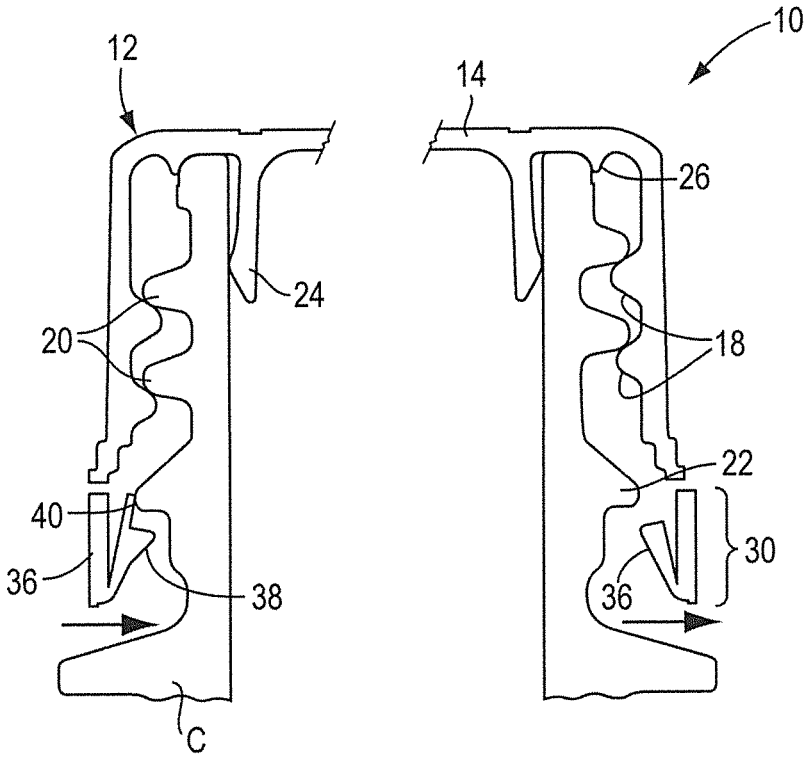
FIG. 4 is a diagrammatic view illustrating a tamper-evident package embodying the principles of the present invention showing cooperation of the present tamper-evident closure with an associated container for enhancing the tamper-indicating properties of the closure.

In order to limit such lateral movement, while desirably avoiding substantially thickening or otherwise strengthening the tamper-ring 36 (which can require increased material, and inhibit closure application), the tamper-ring 36 is provided with a plurality of circumferentially spaced, relatively thick, shoulder-like projections 38 which extend generally inwardly of the tamper-ring 36 when it is in its tamper-indicating orientation, as shown in FIG. 4. Notably, the projections 38, which can have a ramp-like configuration to blend smoothly into the surface of the tamper-ring 36, extend generally radially inwardly of the tamper-ring when it is in its tamper-indicating orientation. By this arrangement, at least one of the projections 38 is positioned to engage the container C generally beneath the locking ring 22, thereby limiting lateral movement of the pilfer band 30 with respect to the container finish. This action is illustrated in FIG. 4, wherein movement of the closure 10 generally in a right-hand direction urges the illustrated projections 38 into engagement with the container C generally beneath locking ring 22, thereby substantially preventing disengagement of the tamper-ring 36 from the locking ring 22 at the portion of the pilfer band opposite the one or more projection which are urged into engagement with the container beneath the locking ring 22.

In a current embodiment of a closure having a 28 mm diameter, tamper-ring 36 has been provided with five (5) equally spaced ones of the projections 38 wherein each projection 38 is on the order of 0.022 inches, that is, the amount that the tamper-ring 36 is thickened at each of the projections 38. The preferred chamfered, smooth configuration of each of the projections 38 avoids any undesired interference of the projections with features of a container finish during closure application. In presently preferred embodiment, the number of frangible bridges 31 is different from, typically greater than, the number of tamper-indicating projections 38, with each of the bridges being non-aligned and spaced from the projections 38. This desirably acts to avoid application of excessive stress to any of the frangible bridges during closure application. The above-described embodiment has five (5) of the projections 38, the closure has been scored at 32 to provide seven (7) of the frangible bridges 31 in non-aligned, spaced relationship with the projections 38.

In accordance with the illustrated embodiment, the tamper-ring 36 includes a plurality of circumferentially spaced tabs 40 which are positionable generally between annular band portion 34 and the container locking ring 32 when the closure is fully applied to the container (see FIG. 4). Tabs 40 desirably enhance the cooperative engagement of the tamper-ring 36 with the locking ring 22. In accordance with the illustrated embodiment, the circumferentially spaced apart tabs 40 extend from a free edge of the tamper-ring 36, and are preferably respectively aligned with the plurality of circumferentially spaced shoulders 38.

Figure 5:
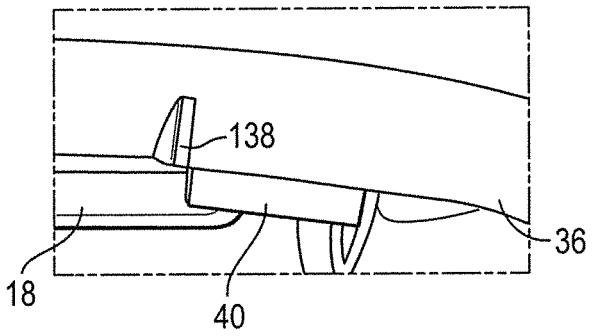
FIG. 5 is a view similar to FIG. 2 illustrating an alternate embodiment of the present invention.

An alternate embodiment of the present invention is illustrated in FIG. 5, wherein the radially extending projections on tamper-ring 36 are provided in the form of circumferentially spaced rib-like projection 138. Projections 138 are configured to function like previously described projections 38 to limit lateral movement of pilfer band 30 with respect to the container locking ring 22. As illustrated, projections 138 can be respectively positioned adjacent to tabs 40.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A plastic closure cap, comprising:

a closed top wall;

a discontinuous annular score defining a series of frangible bridges;

an annular skirt portion depending from said closed top wall to said discontinuous annular score, said skirt portion having an internal thread formation for threaded engagement with an external thread formation on an associated container;

a tamper-indicating pilfer band comprising:

an annular band portion detachably depending from said skirt portion by said frangible bridges, said annular band portion having a continuous interior surface a tamper-ring movable from an axially downward initial orientation to an axially upward orientation, said tamper-ring comprising:

a continuous end having an annular distal edge extending radially inwardly from said annular band portion;

an inner surface proximal to said interior surface of said annular band portion;

an outer surface distal to said interior surface of said annular band portion;

a plurality of circumferentially spaced shoulders, each of said shoulders having a raised free edge protruding from the outer surface and the annular distal edge;

a plurality of circumferentially spaced tabs protruding from the inner surface and spaced from the annular distal edge.

2. The plastic closure cap in accordance with claim 1, wherein said tabs are respectively aligned with said shoulders.

3. The plastic closure cap in accordance with claim 1, wherein said each of said shoulders comprises a rib adjacent said tabs.

4. The plastic closure cap in accordance with claim 1, wherein said frangible bridges are respectively spaced from said shoulders and said frangible bridges outnumber said shoulders.

5. The plastic closure cap in accordance with claim 1, wherein said inner surface of said tamper ring substantially faces said interior surface of said annular band portion when said tamper ring is in said axially upward orientation, said tamper ring is initially molded in said axially downward orientation and subsequently inverted by tooling from said axially downward orientation to said axially upward orientation prior to application of said closure cap to said associated container.

6. The plastic closure cap in accordance with claim 1, wherein said shoulders generally protrude in a first radial direction and said tabs generally protrude in a second radial direction opposite said first radial direction, and said shoulders and said tabs both protrude in a similar axial direction.

7. The plastic closure cap in accordance with claim 1, wherein said shoulders and said tabs are circumferentially elongate with each of said shoulders respectively extending radially further than each of said tabs.

8. A tamper-evident package comprising:

a container having a body and a neck extending upwardly from said body, said neck comprising:

external threading; and, an annular locking ring spaced below said external threads;

a closure having a closed top and a circumferential sidewall extending downwardly from said closed top, said circumferential sidewall comprising:

an upper annular portion having a lower end and internal threading removably fastened to said external threading of said container;

a detachable tamper-indicating pilfer band secured to said container and comprising:

an outer annular wall comprising:

an upper end aligned with said upper annular portion; and, a lower end;

a continuous inner ring comprising:

a free end having an annular edge, said free end extending axially upward and radially inward toward said annular locking ring of said container;

a first annular surface having a plurality of circumferentially spaced raised shoulders protruding said the annular edge of the free end;

a second annular surface opposite said first annular surface and having a plurality of circumferentially spaced tabs having a distal edge spaced from said annular edge of said free end;

a lowermost inverted end continuously joining said lower end of said outer annular wall with said continuous inner ring; and, a discontinuous annular score defining a series of frangible bridges joining said lower end of said upper annular portion to said upper end said outer annular wall of said pilfer band.

9. The tamper-evident package in accordance with claim 8, wherein said first annular surface substantially faces said neck of said container and said second annular surface substantially faces said outer annular wall, and said shoulders are respectively aligned with said tabs.

10. A tamper-evident plastic closure cap, comprising:

a closed top and a circumferential sidewall extending downwardly from said closed top, said circumferential sidewall comprising:

an upper annular portion having a lower end and internal threading; and a detachable tamper-indicating pilfer band comprising:

an outer annular wall comprising:

an upper end aligned with said upper annular portion; and, a lower end;

a continuous inner ring comprising:

a free end having an annular edge, said free end extending axially upward and radially inward of said outer annular wall;

a first annular surface having a plurality of circumferentially spaced raised shoulders protruding said the annular edge of the free end;

a second annular surface opposite said first annular surface and having a plurality of circumferentially spaced tabs having a distal edge spaced from said annular edge of said free end;

a lowermost inverted end continuously joining said lower end of said outer annular wall with said continuous inner ring; and, a discontinuous annular score defining a series of frangible bridges joining said lower end of said upper annular portion to said upper end said outer annular wall of said pilfer band.

* * * * *